US010321709B2

(12) United States Patent
Nelson et al.

(10) Patent No.: US 10,321,709 B2
(45) **Date of Patent: *Jun. 18, 2019**

(54) EQUIPMENT AND ASSOCIATED METHOD FOR INSERTION OF MATERIAL INTO CIGARETTE FILTERS

(71) Applicant: R.J. Reynolds Tobacco Company, Winston-Salem, NC (US)

(72) Inventors: John Larkin Nelson, Lewisville, NC (US); Vernon Brent Barnes, Advance, NC (US); Louis John Read, Jr., Winston-Salem, NC (US); Brent Walker Carter, High Point, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/035,385

(22) Filed: Jul. 13, 2018

(65) Prior Publication Data

US 2018/0317542 A1 Nov. 8, 2018

Related U.S. Application Data

(60) Division of application No. 14/098,636, filed on Dec. 6, 2013, now Pat. No. 10,045,559, which is a (Continued)

(51) Int. Cl.
*A24D 3/02* (2006.01)

(52) U.S. Cl.
CPC ..... *A24D 3/0229* (2013.01); *A24D 3/0225* (2013.01)

(58) Field of Classification Search
None
See application file for complete search history.

(56) References Cited

U.S. PATENT DOCUMENTS 3,288,147 A 11/1966 Molins et al.
3,308,600 A 3/1967 Erdmann et al.
(Continued)

FOREIGN PATENT DOCUMENTS

DE 100 10 176 A1 9/2001
WO WO 03/009711 A1 2/2003
(Continued)

OTHER PUBLICATIONS

Borschke, A. J., "Review of Technologies Relating to Menthol Use in Cigarettes", *Rec. Adv. Tob. Sci.,* 1993, pp. 47-70, No. 19.

*Primary Examiner* — Phu H Nguyen
(74) *Attorney, Agent, or Firm* — Womble Bond Dickinson (US) LLP

(57) ABSTRACT

Filter rods for use in the manufacture of cigarette filter elements are provided, with each rod having a longitudinal axis and incorporating a generally longitudinally extending filter material and a generally longitudinally extending strand within that filter material. A filter making unit receives a continuous supply of a filter material, and forms the filter material into a gathered composite having a continuous cylindrical shape. A continuous supply of a strand (e.g., colored thread) is provided and is introduced into the filter material gathered composite in the tongue of the filter making unit. The filter material and continuous strand positioned therein are formed into a continuous rod having the strand material laterally positioned within that rod, and the continuous rod is subdivided at pre-determined longitudinal intervals to provide a plurality of rod portions.

15 Claims, 5 Drawing Sheets

Related U.S. Application Data continuation of application No. 12/761,052, filed on Apr. 15, 2010, now Pat. No. 8,627,825, which is a division of application No. 11/461,941, filed on Aug. 2, 2006, now Pat. No. 7,740,019.

(56) References Cited

U.S. PATENT DOCUMENTS

| | | | |
|---|---|---|---|
| 3,596,663 | A | 8/1971 | Schultz |
| 3,915,176 | A | 10/1975 | Heitmann et al. |
| 3,972,335 | A | 8/1976 | Tiggelbeck et al. |
| 4,077,415 | A | 3/1978 | Preston et al. |
| 4,082,098 | A | 4/1978 | Owens, Jr. |
| 4,236,535 | A | 12/1980 | Schmidt et al. |
| 4,280,187 | A | 7/1981 | Reuland et al. |
| 4,281,670 | A | 8/1981 | Heitmann et al. |
| 4,281,671 | A | 8/1981 | Bynre et al. |
| 4,291,713 | A | 9/1981 | Frank |
| 4,340,074 | A | 7/1982 | Tudor |
| 4,361,156 | A | 11/1982 | Hall |
| 4,474,190 | A | 10/1984 | Brand |
| 4,508,525 | A | 4/1985 | Berger |
| 4,574,816 | A | 3/1986 | Rudszinat |
| 4,643,205 | A | 2/1987 | Redding et al. |
| 4,646,763 | A | 3/1987 | Nichols |
| 4,655,736 | A | 4/1987 | Keith |
| 4,677,995 | A | 7/1987 | Kallianos et al. |
| 4,715,390 | A | 12/1987 | Nichols et al. |
| 4,726,385 | A | 2/1988 | Chumney, Jr. |
| 4,729,391 | A | 3/1988 | Woods et al. |
| 4,736,754 | A | 4/1988 | Heitmann et al. |
| 4,768,526 | A | 9/1988 | Pryor |
| 4,781,203 | A | 11/1988 | La Hue |
| 4,807,809 | A | 2/1989 | Pryor et al. |
| 4,850,301 | A | 7/1989 | Greene, Jr. et al. |
| 4,862,905 | A | 9/1989 | Green, Jr. et al. |
| 4,878,506 | A | 11/1989 | Pinck et al. |
| 4,941,486 | A | 7/1990 | Dube et al. |
| 5,012,823 | A | 5/1991 | Keritsis et al. |
| 5,012,829 | A | 5/1991 | Thesing et al. |
| 5,025,814 | A | 6/1991 | Raker |
| 5,060,664 | A | 10/1991 | Siems et al. |
| 5,060,665 | A | 10/1991 | Heitmann |
| 5,101,839 | A | 4/1992 | Jakob et al. |
| 5,141,007 | A | 8/1992 | Raker et al. |
| 5,156,169 | A | 10/1992 | Holmes et al. |
| 5,159,944 | A | 11/1992 | Arzonico et al. |
| 5,191,906 | A | 3/1993 | Myracle, Jr. |
| 5,220,930 | A | 6/1993 | Gentry |
| 5,261,425 | A | 11/1993 | Raker et al. |
| 5,387,285 | A | 2/1995 | Rivers |
| 5,396,909 | A | 3/1995 | Gentry et al. |
| 5,469,871 | A | 11/1995 | Barnes et al. |
| 5,510,616 | A | 4/1996 | Seymour et al. |
| 6,229,115 | B1 | 5/2001 | Voss et al. |
| 6,360,751 | B1 | 3/2002 | Fagg et al. |
| 6,537,186 | B1 | 3/2003 | Veluz |
| 6,647,878 | B2 | 11/2003 | Blau et al. |
| 6,848,449 | B2 | 2/2005 | Kitao et al. |
| 6,904,917 | B2 | 6/2005 | Kitao et al. |
| 7,074,170 | B2 | 7/2006 | Lanier, Jr. et al. |
| 7,972,254 | B2 | 7/2011 | Stokes et al. |
| 8,627,825 | B2 * | 1/2014 | Nelson ..... A24D 3/0229 131/70 |
| 2002/0020420 | A1 | 2/2002 | Xue et al. |
| 2002/0166563 | A1 | 11/2002 | Jupe et al. |
| 2003/0136419 | A1 | 7/2003 | Muller |
| 2003/0145866 | A1 | 8/2003 | Hartmann |
| 2003/0172942 | A1 | 9/2003 | Schlisio |
| 2003/0224918 | A1 | 12/2003 | Lanier, Jr. et al. |
| 2004/0129281 | A1 | 7/2004 | Hancock et al. |
| 2004/0261807 | A1 | 12/2004 | Dube et al. |
| 2005/0039764 | A1 | 2/2005 | Barnes et al. |
| 2005/0076929 | A1 | 4/2005 | Fitzgerald et al. |
| 2005/0103355 | A1 | 5/2005 | Holmes |
| 2005/0194014 | A1 | 9/2005 | Read, Jr. |
| 2005/0255978 | A1 | 11/2005 | Lather, Jr. et al. |
| 2006/0169295 | A1 | 8/2006 | Draghetti |
| 2006/0272654 | A1 | 12/2006 | Barnes et al. |
| 2006/0272655 | A1 | 12/2006 | Thomas et al. |
| 2007/0006888 | A1 | 1/2007 | Hicks et al. |
| 2007/0017536 | A1 | 1/2007 | Tobias et al. |
| 2007/0056600 | A1 | 3/2007 | Coleman et al. |
| 2008/0308114 | A1 | 12/2008 | Fowles |

FOREIGN PATENT DOCUMENTS

| | | | |
|---|---|---|---|
| WO | WO 03/047836 | A1 | 6/2003 |
| WO | WO 06/016154 | A2 | 2/2006 |
| WO | WO 2006/059134 | A1 | 6/2006 |
| WO | WO 2006/064371 | A1 | 6/2006 |
| WO | WO 2007/085830 | A2 | 8/2007 |

* cited by examiner

EQUIPMENT AND ASSOCIATED METHOD FOR INSERTION OF MATERIAL INTO CIGARETTE FILTERS

CROSS REFERENCE TO RELATED APPLICATION

This application is a divisional of U.S. application Ser. No. 14/098,636, filed Dec. 6, 2013; which is a continuation of U.S. application Ser. No. 12/761,052, filed Apr. 15, 2010 (now U.S. Pat. No. 8,627,825); which is a divisional of U.S. application Ser. No. 11/461,941, filed Aug. 2, 2006 (now U.S. Pat. No. 7,740,019), the contents of which are herein incorporated by reference in their entirety.

BACKGROUND OF THE INVENTION

Embodiments of the present invention relate to apparatuses and methods for manufacturing smoking articles, and components of smoking articles, such as filter elements. In particular, embodiments of the present invention relate to apparatuses and methods for inserting material within the filter material component that is used for the manufacture of a filter element for a smoking article, such as a cigarette.

DESCRIPTION OF RELATED ART

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. See, for example, U.S. Pat. No. 6,537,186 to Veluz; PCT Publication No. WO 2006/064371 to Banerjea; and U.S. patent application Ser. No. 11/226,932, filed Sep. 14, 2005, to Coleman III, et al.; each of which is incorporated herein by reference. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Various attempts to alter the visual attributes of cigarettes have been proposed. For example, there have been attempts to alter the color of the wrapping materials that provide the wrapping material of the tobacco rod (e.g., cigarettes marketed under the trade name "More" by R. J. Reynolds Tobacco Company possess cigarette rod wrapping papers exhibiting a brown color) and tipping materials used to attach the tobacco rod to the filter element (e.g., tipping materials have been printed so as to possess a "cork" appearance and/or to possess at least one circumscribing ring). In addition, there have been attempts to alter the appearance of the filter elements of cigarettes. See, for example, the types of cigarette filter element formats, configurations and designs set forth in U.S. Pat. No. 3,596,663 to Schultz; U.S. Pat. No. 4,508,525 to Berger; U.S. Pat. No. 4,655,736 to Keith; U.S. Pat. No. 4,726,385 to Chumney, Jr.; U.S. Pat. No. 4,807,809 to Pryor et al.; and U.S. Pat. No. 5,025,814 to Raker; each of which is incorporated herein by reference.

The sensory attributes of cigarette smoke can be enhanced by applying additives to tobacco and/or by otherwise incorporating flavoring materials into various components of a cigarette. See, Leffingwell et al., Tobacco Flavoring for Smoking Products, R.J. Reynolds Tobacco Company (1972). For example, one type of tobacco flavoring additive is menthol. See, Borschke, *Rec. Adv. Tob. Sci.,* 19, p. 47-70, 1993. Various proposed methods for modifying the sensory attributes of cigarettes include certain filter elements that may be used for adding flavor to the mainstream smoke of those cigarettes. U.S. Patent Application Publication No. 2002/0166563 to Jupe et al. proposes the placement of adsorbent and flavor-releasing materials in a cigarette filter. U.S. Patent Application Publication No. 2002/0020420 to Xue et al. proposes the placement of fibers containing small particle size adsorbents/absorbents in the filter. U.S. Pat. No. 4,941,486 to Dube et al. and U.S. Pat. No. 4,862,905 to Green, Jr. et al., which are incorporated herein by reference, propose manners and methods for the placement of a flavor-containing pellet in each cigarette filter. Other representative types of cigarette filters incorporating flavoring agents are set forth in U.S. Pat. No. 3,972,335 to Tiggelbeck et al.; U.S. Pat. No. 4,082,098 to Owens, Jr.; U.S. Pat. No. 4,281,671 to Bynre; U.S. Pat. No. 4,729,391 to Woods et al.; U.S. Pat. No. 4,768,526 to Pryor; U.S. Pat. No. 5,012,829 to Thesing et al.; U.S. Pat. No. 5,387,285 to Rivers; and U.S. Pat. No. 7,074,170 to Lanier, Jr. et al.; each of which is incorporated herein by reference. See, also, the types of cigarette filter technologies that are discussed in the background art section set forth in U.S. Patent Application Publication No. 2004/0261807 to Dube et al.; which is incorporated herein by reference.

It would be highly desirable to provide a smoker with the ability to enhance his/her smoking experience, such as can be accomplished by providing a filtered cigarette possessing a filter element having particular design features. That is, it would be desirable to provide a cigarette possessing filter components that are employed in a manner such that the filter element is aesthetically pleasing. It also would be desirable to provide such a filter element possessing selected design features that can be modified or otherwise controlled. In addition, it would be desirable to provide a filter element for a cigarette that is capable of enhancing the sensory attributes of the mainstream smoke (e.g., by flavoring the mainstream smoke) produced by that cigarette.

BRIEF SUMMARY OF THE INVENTION

The above and other needs are met by embodiments of the present invention, which provide apparatuses and methods for manufacturing filter rods for use in the manufacture of smoking articles, such as cigarettes. Filter rods are produced such that each such rod has a filament material (e.g., at least one strand) extending through its length. A continuous supply of filter material (e.g., as is provided using a filter tow processing unit) is provided to a continuous filter rod forming unit. Typically, a plasticizer (e.g., triacetin) is applied to the filter material, particularly when the filter material is cellulose acetate tow. The continuous rod forming unit possesses a garniture region for receiving filter material that has been fashioned into a generally cylindrical shape, and either (i) for wrapping the continuous supply of gathered filter material so provided within a circumscribing web of plug wrap, or (ii) for steam bonding the plasticized filter material. In addition, a spool, bobbin, or other mechanism provides a continuous supply of strand-like material (e.g., colored thread can be supplied from a spool). That strand-like material is introduced into the continuous supply of filter material as that filter material is introduced into the garniture region of the rod forming unit. In a preferred aspect, a tube that acts as a guide for the continuous strand is configured and positioned so as to allow for feeding and positioning of that strand material into the filter material while that filter material is within the tongue region of the filter making unit. As such, the filter material is formed into a continuous rod having a continuous strand extending longitudinally through that rod and generally parallel to the longitudinal axis of that rod. The continuous rod then is subdivided at predetermined longitudinal intervals so as to form a plurality of filter rods (e.g., four-up generally cylindrical filter rods each containing a strand that extends generally longitudinally therethrough).

Thus, one aspect of the present invention relates to an apparatus for providing rods for use in the manufacture of cigarette filter elements, each rod having a longitudinal axis and incorporating generally longitudinally extending filter material and a generally longitudinally extending strand within that filter material. Such an apparatus comprises (a) means for providing a continuous supply of filter material; (b) means for forming the filter material into a gathered composite having a continuous rod-like shape; (c) means for supplying a continuous strand; (d) means for introducing the continuous strand into the filter material gathered composite; (e) means for forming the filter material and continuous strand positioned therewithin into a continuous rod having the strand material positioned within that rod; and (f) means for subdividing the continuous rod at pre-determined longitudinal intervals to provide a plurality of rods.

Another aspect of the present invention relates to a process for providing rods of the type set forth herein. Such a process involves (a) providing a continuous supply of filter material; (b) forming the filter material into a gathered composite having a continuous rod-like shape; (c) supplying a continuous strand; (d) introducing the continuous strand into the filter material gathered composite; (e) forming the filter material and continuous strand positioned therewithin into a continuous rod having the strand material positioned within that rod; and (f) subdividing the continuous rod at pre-determined intervals to provide a plurality of rods.

A further aspect of the present invention comprises an apparatus for manufacturing a rod for a cigarette filter element, wherein each rod defines a longitudinal axis and includes a generally longitudinally-extending filter material and a generally longitudinally-extending strand disposed within that filter material. Such an apparatus includes a rod-forming unit configured to form a continuous supply of a filter material into a continuous cylindrical gathered composite. A strand insertion unit is configured to receive the gathered composite from the rod-forming unit and to introduce a continuous strand of a filament material into the gathered composite such that the continuous strand is selectively laterally disposed within the gathered composite.

Still another aspect of the present invention comprises a method for manufacturing a rod for a cigarette filter element, wherein each rod defines a longitudinal axis and includes a generally longitudinally-extending filter material and a generally longitudinally-extending strand disposed within that filter material. Such a method includes forming a continuous supply of a filter material into a continuous cylindrical gathered composite using a rod-forming unit, and introducing a continuous strand of a filament material into the gathered composite using a strand insertion unit such that the continuous strand is selectively laterally disposed within the gathered composite.

Embodiments of the present invention thus provide significant advantages as further detailed herein.

BRIEF DESCRIPTION OF THE SEVERAL VIEWS OF THE DRAWINGS

Figure 1:
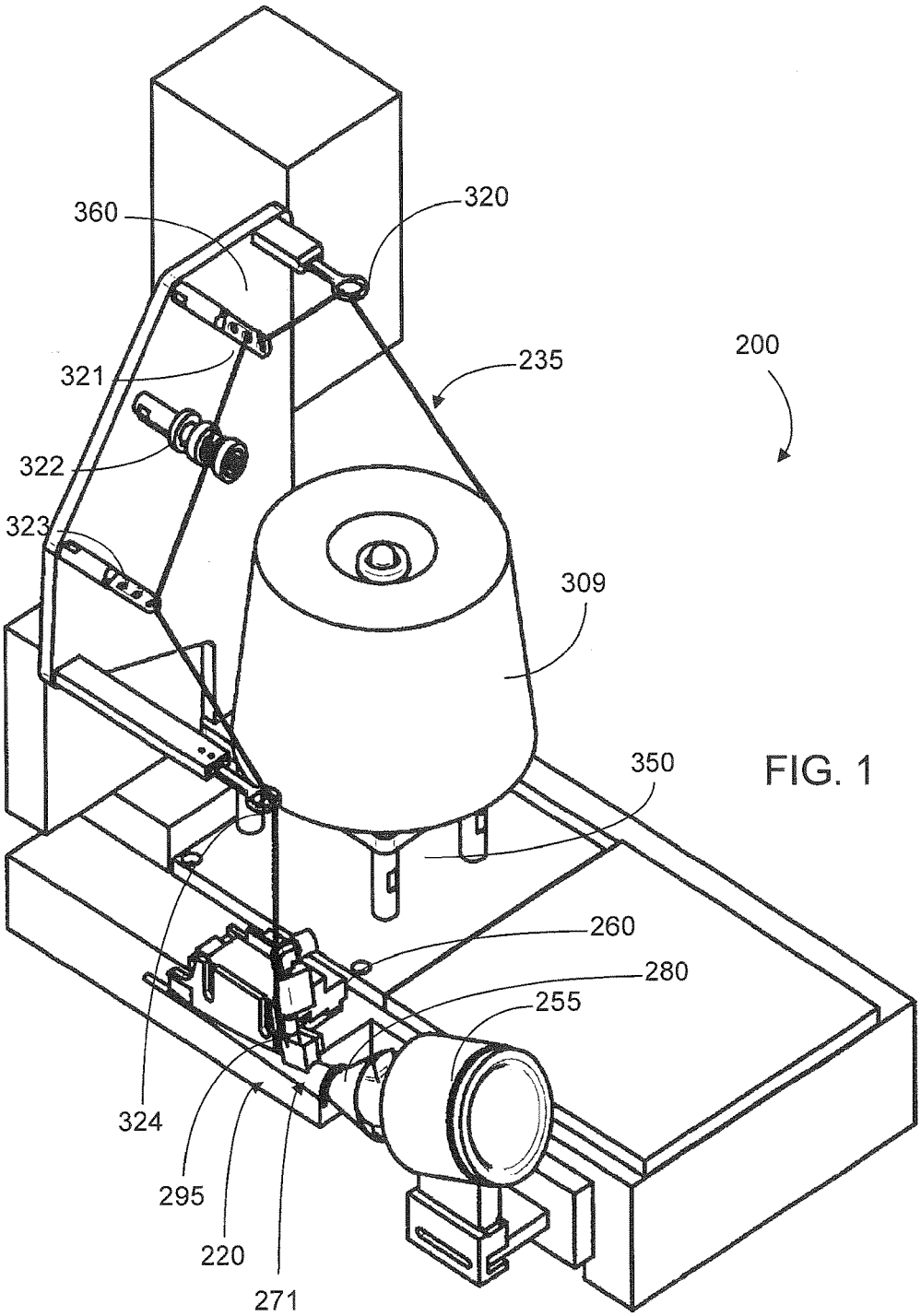
Figure 2:
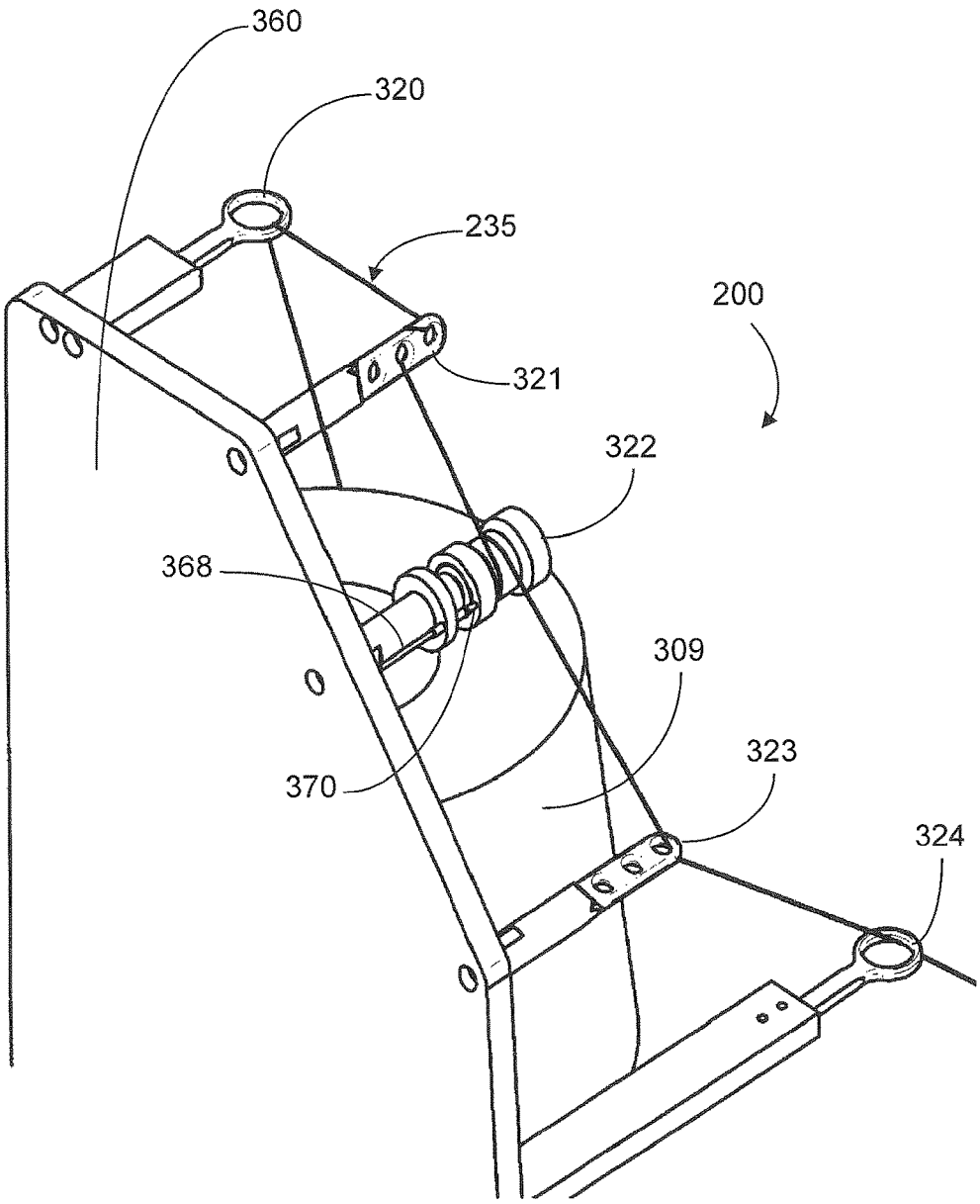
Figure 3:
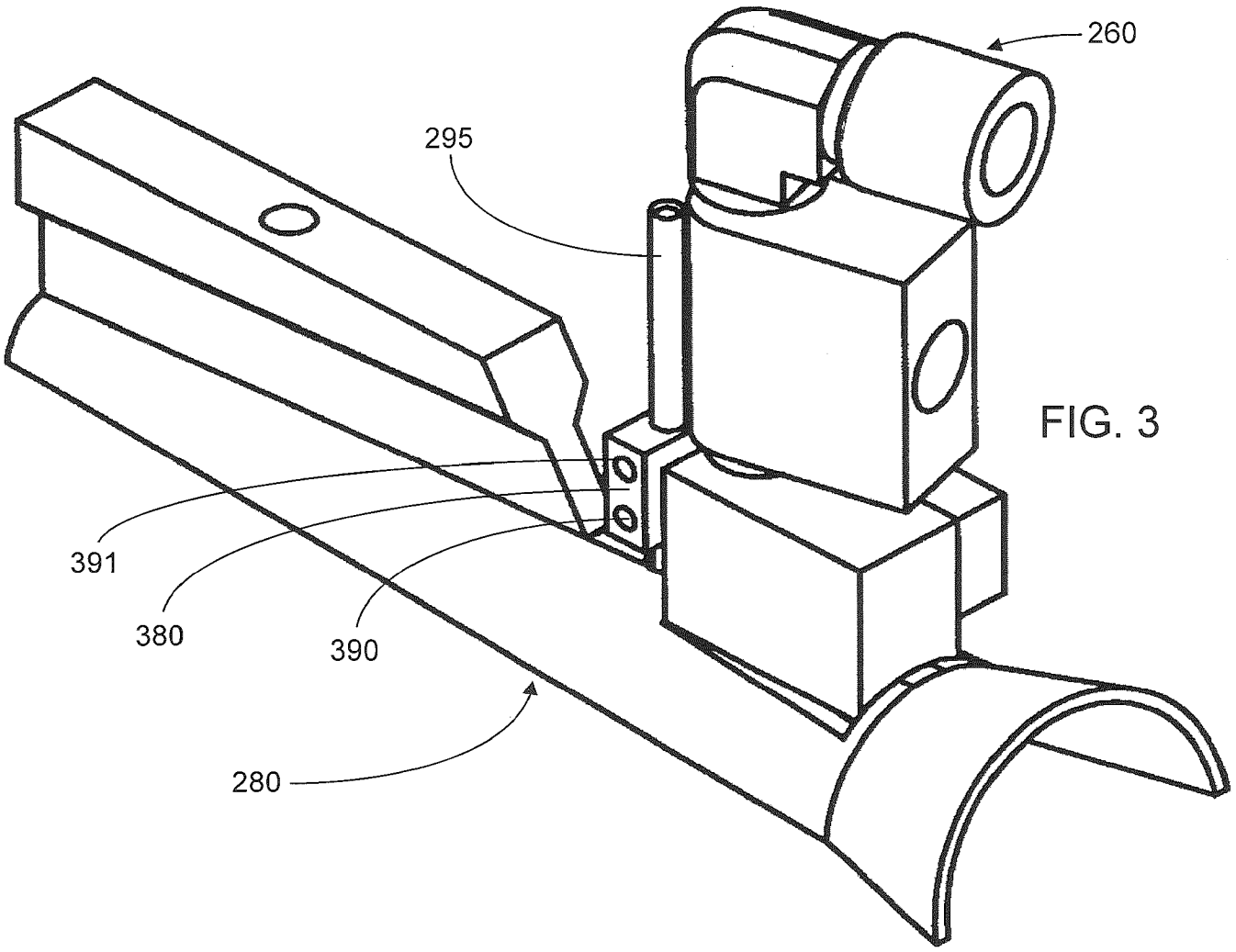
Figure 4:
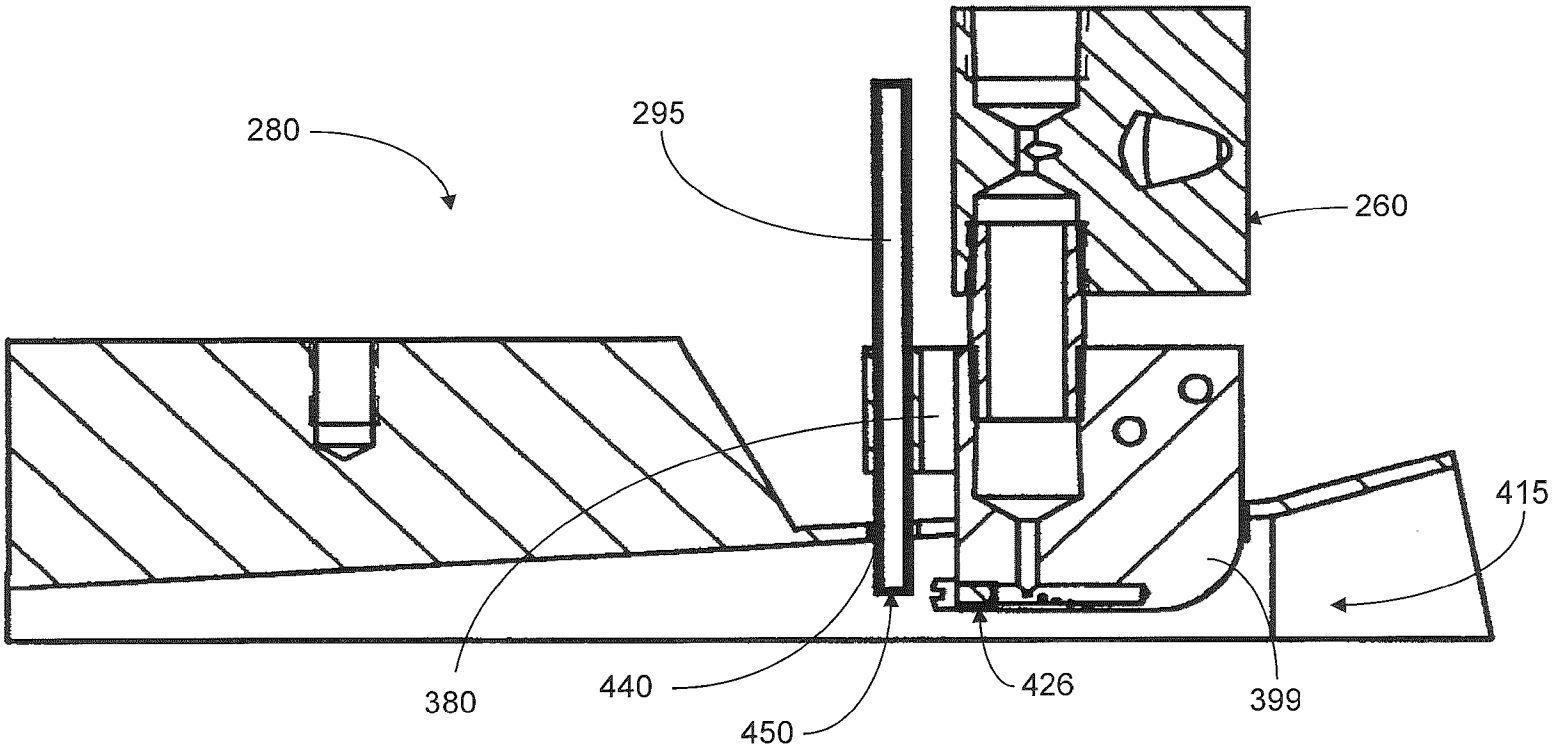
Figure 5:
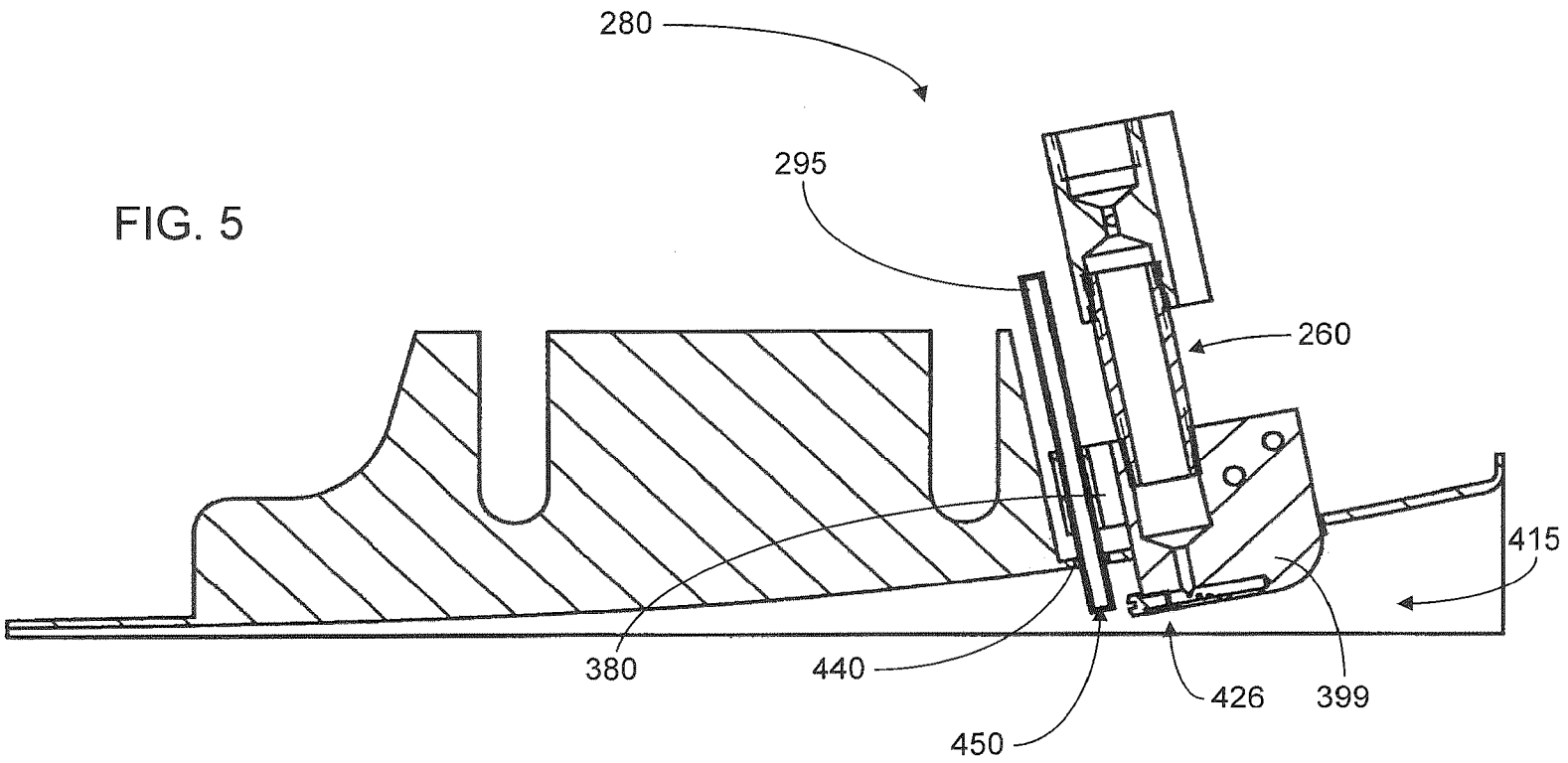

Having thus described the invention in general terms, reference will now be made to the accompanying drawings, which are not necessarily drawn to scale, and wherein:

FIG. 1 is a perspective view of a portion of a filter rod-making apparatus, including a portion of the garniture region, a source of strand, and a strand insertion unit, according to one embodiment of the present invention;

FIG. 2 is a perspective view of a portion of the apparatus shown in FIG. 1;

FIG. 3 is a perspective view of a tongue of filter rod-making apparatus and thread insertion unit according to one embodiment of the present invention;

FIG. 4 is a cross-sectional view of tongue and thread insertion unit of the type shown in FIG. 3; and FIG. 5 is a cross-sectional view of tongue and thread insertion unit according to one embodiment of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Cigarette rods are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Filtered cigarettes incorporating filter elements provided from filter rods that are produced in accordance with the present invention can be manufactured using traditional types of cigarette making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; and U.S. Pat. No. 6,229,115 to Vos et al.; and U.S. Patent Application Publication Nos. 2005/0103355 to Holmes and 2005/1094014 to Read, Jr.; each of which is incorporated herein by reference. The operation of those types of devices will be readily apparent to those skilled in the art of automated cigarette manufacture.

Cigarette filter rods that are produced in accordance with the present invention can be used to provide multi-segment filter rods. Such multi-segment filter rods can be employed for the production of filtered cigarettes possessing multi-segment filter elements. An example of a two-segment filter element is a filter element possessing a first cylindrical segment incorporating activated charcoal particles (e.g., a "dalmation" type of filter segment) at one end, and a second cylindrical segment that is produced from a filter rod produced in accordance with embodiments of the present invention. The production of multi-segment filter rods can be carried out using the types of rod-forming units that have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany.

Various types of cigarette components, including tobacco types, tobacco blends, top dressing and casing materials, blend packing densities; types of paper wrapping materials for tobacco rods, types of tipping materials, and levels of air dilution, can be employed. See, for example, the various representative types of cigarette components, as well as the various cigarette designs, formats, configurations and characteristics, that are set forth in U.S. Pat. No. 5,220,930 to Gentry and U.S. Pat. No. 6,779,530 to Kraker; U.S. Patent Application Publication Nos. 2005/0016556 to Ashcraft et al. and 2005/0066986 to Nestor et al.; and U.S. patent application Ser. No. 11/375,700, filed Mar. 14, 2006, to Thomas et al. and Ser. No. 11/408,625, filed Apr. 21, 2006, to Oglesby; each of which is incorporated herein by reference.

Filter rods can be manufactured pursuant to embodiments of the present invention using a rod-making apparatus, and an exemplary rod-making apparatus includes a rod-forming unit. Representative rod-forming units are available as KDF-2 and KDF-3E from Hauni-Werke Korber & Co. KG; and as Polaris-ITM Filter Maker from International Tobacco Machinery. Filter material, such as cellulose acetate filamentary tow, typically is processed using a conventional filter tow processing unit. For example, filter tow can be bloomed using bussel jet methodologies or threaded roll methodologies. An exemplary tow processing unit has been commercially available as E-60 supplied by Arjay Equipment Corp., Winston-Salem, N.C. Other exemplary tow processing units have been commercially available as AF-2, AF-3 and AF-4 from Hauni-Werke Korber & Co. KG. and as Candor-ITM Tow Processor from International Tobacco Machinery. Other types of commercially available tow processing equipment, as are known to those of ordinary skill in the art, can be employed. Other types of filter materials, such as gathered paper, nonwoven polypropylene web or gathered strands of shredded web, can be provided using the types of materials, equipment and techniques set forth in U.S. Pat. No. 4,807,809 to Pryor et al. and U.S. Pat. No. 5,025,814 to Raker. In addition, representative manners and methods for operating a filter material supply units and filter-making units are set forth in U.S. Pat. No. 4,281,671 to Byrne; U.S. Pat. No. 4,850,301 to Green, Jr. et al.; U.S. Pat. No. 4,862,905 to Green, Jr. et al.; U.S. Pat. No. 5,060,664 to Siems et al.; U.S. Pat. No. 5,387,285 to Rivers and U.S. Pat. No. 7,074,170 to Lanier, Jr. et al.

During use of a filter-making apparatus, a continuous length or web of filter material is supplied from a source such as a storage bale, bobbin, or the like. The continuous length of filter material is pulled through a gathering region of the rod-forming unit. The gathering region can have a tongue and horn configuration, a gathering funnel configuration, a stuffer or transport jet configuration, or other suitable types or combinations of gathering mechanisms. A tongue provides for further gathering, compaction, conversion or formation of a cylindrical composite of filter material into an essentially cylindrical (i.e., rod-like) shape whereby the continuously extending strands or filaments of the filter material extend essentially along the longitudinal axis of the cylinder so formed.

The filter material that has been compressed into a cylindrical composite is received further into a garniture region. That is, the cylindrical composite is fed into a wrapping mechanism, which includes an endless garniture conveyer belt. The garniture conveyer belt is continuously and longitudinally advanced using an advancing mechanism (not shown) such as a ribbon wheel or cooperating drum so as to transport the cylindrical composite through the wrapping mechanism. The wrapping mechanism provides and applies a strip of wrapping material, such as a web of porous or non-porous paper plug wrap, to the outer surface of the cylindrical composite in order to produce continuous wrapped rod.

The strip or web of wrapping material is provided from rotatable bobbin, or other suitable source. The wrapping material is drawn from the bobbin, is trained over a series of guide rollers, and enters the wrapping mechanism of the rod-forming unit. The endless garniture conveyer belt transports both the strip of wrapping material and the cylindrical composite downstream in a longitudinally extending manner through the wrapping mechanism while draping or enveloping the wrapping material about the cylindrical composite.

The seam formed by an overlapping marginal portion of wrapping material has adhesive (e.g., hot melt adhesive) applied thereto at applicator region in order that the wrapping material can form a tubular container for the filter material. Alternatively, the hot melt adhesive may be applied directly upstream of the wrapping material's entry into the garniture region of the wrapping mechanism. The adhesive can be cooled using a chill bar in order to cause rapid setting of the adhesive. It is understood that various other sealing mechanisms and other types of adhesives can be employed in providing the continuous wrapped rod. As such, there is provided a manner or method for supplying a continuous supply of plug wrap, circumscribing the longitudinal periphery of a continuous supplied filter material gathered composite, and hence forming a continuous filter rod circumscribed by plug wrap.

The continuous wrapped rod passes from the sealing mechanism and is subdivided (e.g., severed) at regular intervals at the desired, predetermined length using a cutting assembly, which includes as a rotary cutter, a highly sharpened knife, or other suitable rod cutting or subdividing mechanism. It is particularly desirable that the cutting assembly does not flatten or otherwise adversely affect the cross-sectional shape of the rod. As such, the filter material supplied to a filter-making unit is formed into a continuous rod, which is subdivided, using a rod cutting assembly, into a plurality of filter rods or rod portions. The succession or plurality of rod portions are collected for further use, using a tray, a rotary collection drum, conveying system, or the other suitable collection mechanism. If desired, the rod portions can be transported directly to a cigarette making machine. In such a manner, a continuous rod can be manufactured at a rate of greater than about 200 meters per minute, often greater than about 300 meter per minute, and frequently greater than about 400 meters per minute.

Referring to FIG. 1, there is shown a portion of a rod-making unit 200, such as a portion of a rod-forming unit available as KDF-2 from Hauni-Werke Korber & Co. KG. The rod-forming unit is equipped with a strand insertion unit 220, which is suitably adapted to provide for placement of continuous strand of material 235, such as a filament material, within a continuous length of filter material (not shown). The representative rod-making unit is arranged so that the filter material is fed into the tongue 250 from a stuffer jet device 255.

For the embodiment shown, an optional, though preferred, flavor injection port 260 is positioned in the filter material gathering region 271 of the rod-forming unit 220. For example, a flavor injection system 271 is located so as to provide for injection of a flavor formulation into the tongue 280 of the rod-forming unit. Associated flavor formulation supply tubes, flavor reservoirs, pumping mechanisms, and formulation metering systems for the flavor injection system are not shown. A representative flavor injection system is set forth in U.S. Pat. No. 5,387,285 to Rivers. An exemplary flavor formulation is composed of a mixture of menthol and propylene glycol.

For the embodiment shown, components of the strand insertion unit 220 also are positioned in the filter material gathering region 271 of the rod-forming unit 220. The strand insertion unit 220 possesses an insertion tube 295 that extends through the tongue 280 in a region downstream from the flavor injection system 260. If desired, for an embodiment not shown, the insertion tube and flavor injection system each can be similarly configured, but the strand insertion tube can be positioned upstream of the flavor injection system.

The stand insertion unit also possesses a spool 309, bobbin, or other mechanism for providing a continuous supply of strand-like filament material 235 (e.g., thread can be supplied from a spool). The strand 235 passes through a series of guides 320, 321, 322, 323, 324, and through the insertion tube 295. The spool 309 can be located and supported on a spool support base 350 positioned on, and most preferably secured to, an appropriate region the frame region of the rod-forming unit 200. For example, the hollow core of the spool can be supported on an upwardly extending axle type member. Alternatively, for an embodiment not shown, the spool can be positioned on a separate stand or base. As such, the spool can be maintained securely in position, and the strand can be readily removed therefrom, during operation of the rod-making unit. Similarly, the various guides 320, 321, 322, 323, 324 can be located and supported on a guide support base 360 positioned on, and most preferably secured to, an appropriate region the frame region of the rod-forming unit 200. Alternatively, for an embodiment not shown, the spool can be positioned on a separate stand or base. As such, the strand can be removed from the spool at an appropriate rate and effectively guided through the insertion tube 295 during operation of the rod-making unit.

During use, the filter material (not shown), such as plasticized cellulose acetate tow is fed into the stuffer jet 255, and then passes into the tongue 280. The flavoring agent optionally, though preferably, is applied to the filter material that enters the tongue. Downstream therefrom, the continuous strand is introduced into the filter material through the insertion tube 295 in the tongue 280. As the filter material and strand pass downstream through the rod-forming unit, a continuous filter rod (not shown) is formed.

Referring to FIG. 2, a representative strand insertion unit 220 possesses a spool 309 that supplies a continuous length or strand 235 of the filament material (e.g., thread) through a eyelet type of guide 320, through a 3-hole thread guide type of guide 321, around a roll guide 322 (e.g., a roll guide of the general type used to convey a continuous paper web in commercial cigarette component manufacturing operations), through another 3-hole type of guide 323, through another eyelet type guide 324, and ultimately through the strand insertion tube (not shown). The various guides are located on, and appropriately secured to, the guide support base 360. For the embodiment shown, the guide base extends in a generally vertical direction, and the guides each extend in a generally horizontal direction. However, other types or configurations of guide mechanisms, numbers of guides and strand pathways can be employed, and alternative designs will be apparent to those skilled in the art of continuous supply and transport of a strand of a filament material, such as thread. It is preferable that the guide located nearest the strand insertion tube be adjustable (e.g., up/down, back/forth, side-to-side) in order that the strand can be efficiently and effectively directed into the strand insertion tube.

Most preferably, the strand insertion unit 220 possesses an electronic sensing or monitoring system that is designed to ensure that strand is being provided from the spool 309 to desired locations downstream in the filter making system. A representative monitoring system is provided by mounting a fiber optic sensor head 368 (e.g., a sensor head available as FU-68 from Keyence Corporation) near the roll guide 322. As such, the sensor head 368 can sense rotational movement of the roll guide as the strand 235 that is wrapped around that roll guide provides rotation of that roll guide during movement of that strand. Typically, a pin 370 or other appropriate timing mark located on a rotational portion of the roll guide 322 can provide suitable information for detection by a stationary mounted sensor head 370. The sensor head can be connected (e.g., using appropriate wiring) to a photosensor (not shown), that can be, in turn, connected to a programmable logic controller (PLC) (not shown). The PLC can be, in turn, connected to the electronic control system of the rod-making unit. A representative photosensor is available as FS 2-60 from Keyence Corporation, and a representative PLC is available as KV-10R from Keyence Corporation. The resulting system can be appropriately programmed so that when the rotational movement of the roll guide 322 ceases (e.g., as a result of the continuous strand being broken), the monitoring system can sense that change in the operation of strand insertion unit, and the operation of the rod-making unit can be shut down. As such, manufacture of filter rods possessing strands therein can be assured.

Referring to FIG. 3, there is shown a tongue 280, and in particular, an upstream portion of a so-called "two piece" tongue. A representative "two piece" tongue is available as Part No. 132DF3002 from Hauni-Werke Korber & Co. KG. At the upstream end of the tongue is located a flavor insertion port 260. Downstream from the flavor insertion unit is the insertion tube 295 for insertion of a strand (not shown) into the filter material (not shown). Toward the lower end of the insertion tube is a tube mounting bracket 380, which most preferably possesses positioning screws 390, 391, or other mechanism for adjusting the positioning of the strand in a pre-determined location within the filter material gathered composite. That is, the positioning of tube within the tongue can be selected within the horizontal plane so as to provide from placement of the strand at a desired longitudinal location within the filter material passing through the tongue; and as such, placement of the opening in the top face of the tongue for the insertion tube can be selected (e.g., so as to be within the center longitudinal region of the filter material gathered composite, from a horizontal perspective). In addition, positioning of the tube can be readily controlled in a vertical manner by adjustment of the positioning screws (e.g., so as to provide the strand material in the center region of the filter material gathered composite, or laterally with respect to the cross-section of the filter material gathered composite, from a vertical perspective).

Referring to FIG. 4, there is shown a cross-sectional view of the tongue 280 described previously with reference to FIG. 3. The flavor injection port 260 extends downward into the tongue, and as such its lower region 399 extends into the path of travel 415 of the filter material (not shown). As such, flavoring agent is injected into the filter material in flavor application region 426 of the flavor insertion port. The insertion tube 295 supported by a tube mounting bracket 380 extends through an opening 440 in the tongue. A representative opening 440 for an insertion tube having a generally circular outer cross-sectional shape is generally circular in shape, and can be drilled, formed, or otherwise fashioned within the tongue. The insertion tube is movable in the opening, and the tube mounting bracket 380 is connected to the frame of the flavor injection port (e.g., using screws, spot welds, adhesive, or other suitable fastening mechanism), or in an appropriate location elsewhere within that region of the rod-forming unit. The extreme downstream end 450 of the insertion tube 295 is positioned generally in the center region in the path of travel 415 of the filter material. For the embodiment shown, the extreme downstream face of the flavor insertion unit within the path of travel is about 4 mm to about 6 mm from the extreme upstream face of the insertion tube. As such, there is shown a tongue possessing (i) a first entrance or first receiving port at one end for receiving the filter material and an exit or discharge port at the other end for discharge of a filter material gathered composite incorporating generally longitudinally extending filter material and generally longitudinally extending continuous strand, (ii) a second entrance or second receiving port, physically separate from the first entrance and located toward the exit of the tongue, for introducing the strand into the filter material, and (iii) an optional third entrance or third receiving port, physically separate from both the first and second entrances, and located between the first and second entrances, for introducing flavoring agent into the filter material gathered composite.

Referring to FIG. 5, there is shown a cross-sectional view of the tongue 280, and in particular, a so-called "one piece" tongue. A representative "one piece" tongue is available as Part No. 132DF3003F from Hauni-Werke Korber & Co. KG. The flavor insertion unit 260 extends downward into the tongue, and as such its lower region 399 extends into the path of travel 415 of the filter material (not shown). As such, flavoring agent is injected into the filter material in the application region 426 of the flavor insertion unit. The insertion tube 295 supported by the tube mounting bracket 380 extends through on opening 440 in the tongue. The extreme downstream end 450 of the insertion tube 295 is positioned generally in the center region (with respect to cross-section of the filter material) in the path of travel 415 of the filter material. For the embodiment shown, the extreme downstream face of the flavor insertion unit within the path of travel is about 4 mm to about 6 mm from the extreme upstream face of the insertion tube.

The insertion tube can vary. Typically, the insertion tube is manufactured from a metallic material, such as stainless steel, or the like. Typically, the length of the insertion tube ranges from about 40 to about 60 mm, although longer or shorter insertion tube designs can be employed. Typically, the inner diameter of a representative insertion tube having a generally circular cross-section, such as one designed for insertion of a strand of a string or thread into a filter material, is about 2 to about 2.8 mm, often about 2.2 to about 2.5 mm; and the outer diameter of such a representative tube having a generally circular cross-section, is about 3 mm to about 4 mm. The cross-sectional shape of the outer portion of the tube and/or of the inner passageway of the tube can be modified, if desired. For example, the outer portion of the tube can be fashioned so as to possess a "plow-like" shape, that is, a narrower width at its upstream face and a wider width at its downstream face. The inner passageway of the tube can be modified, for example, to possess an oval cross-sectional shape, or any other suitable shape, about the extreme downstream end 450 of the insertion tube 295.

The tube is configured so as to define a path of travel of the strand. That is, the tongue provides a path of travel of the filter material gathered composite, while the tube is configured so as to define passage of travel of the strand into the gathered composite by extending into the path of travel of the gathered composite. That is, the strand is discharged from the tube according to the angle of orientation thereof (i.e., the strand is vertically discharged into the gathered composite from a vertically-oriented tube). Once discharged from the tube, the strand engages the gathered composite at the selected lateral disposition therein, and is thus continuously fed into and travels downstream with the longitudinally-proceeding gathered composite. The disposition of the tube in the tongue relative to vertical can be altered by loosening the attachment screws (or other fastening mechanism), adjusting the insertion tube in the vertical plane (e.g., up and down, by hand), and tightening the screws (or otherwise providing secure positioning of the insertion tube). In some instances, the tube may also be adjustable with respect to the angle thereof with respect to the path of travel of the filter material gathered composite. That is, the tube may be adjustable to form an acute angle (i.e., greater than 0° and less than 90°) with respect to the path of travel of the filter material gathered composite (i.e., inclined upstream or inclined downstream). In some instances, in order to facilitate the introduction of the strand into the gathered composite, the extreme downstream end 450 of the insertion tube 295 may be configured to be at least one of arcuately-shaped, smooth, beaded, rounded, radiused, chamfered, plow-shaped, and combination thereof, so as to facilitate transition of the orientation of the strand from the discharge orientation upon discharge from the tube to the orientation of the path of travel of the gathered composite. In other optional instances, the insertion tube 295 may be configured such that the strand is introduced into the gather composite, for example, at a slightly slower rate than the advancement rate of the gathered composite along its path of travels where, in such instances, the difference in rates may provide, for example, a tension in the strand as it is introduced into the gathered composite.

In a preferred embodiment, the tongue possesses a first entrance at one end for filter material and an exit at the other end for a filter material gathered composite incorporating the generally longitudinally extending filter material and the generally longitudinally extending continuous strand. The entrance and exit each allow for a path of travel of the filter material in a generally horizontal plane. The second entrance, physically separate from the first entrance and located toward the exit of the tongue, is adapted for introduction of the strand into the filter material. The second entrance provides for a path of travel of the strand into the filter material in and from a generally vertical plane. The third entrance, physically separate from both the first and second entrances, and located between the first and second entrances, is adapted to provide injection of flavoring agent into the filter material. Preferably, the flavor injection system extends into the path of travel of the filter material, and acts as a type of plow, or mechanism for separating or creating a channel in the filter material gathered composite. The third entrance is located in generally vertical plane. In such an embodiment, the second and third entrances of the tongue preferably have the form of openings through the upper face.

The filter material can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefin material such as polypropylene, or the like. One filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference. Typically, filamentary filter materials used for cigarette filter rod manufacture are generally white in color. However, if desired, filamentary filter materials of other colors can be employed. In some instances, the color of the filamentary filter material may correspond to the nature of the smoke modifying agent, such as the flavoring agent, applied thereto by the flavor injection system (e.g., a red color corresponding to a cinnamon flavor, a green color corresponding to a menthol flavor, a black color corresponding to a licorice flavor, or the like).

Normally a plasticizer such as triacetin is applied to the filamentary tow in traditional amounts using known techniques. Other suitable materials or additives used in connection with the construction of the filter element will be readily apparent to those skilled in the art of cigarette filter design and manufacture.

The material from which the strand is manufactured can vary. Exemplary strands/filament materials can be manufactured from woven natural fiber (e.g., cotton), woven synthetic fiber (e.g., nylon, polyester or cellulose acetate), extruded material (e.g., polyethylene), or the like. Preferred strand materials are woven materials, such as those that can be characterized as string, thread or yarn. The strand material can act as a carrier for a material that can be used to alter the behavior of the mainstream smoke that passes through a filter element incorporating that strand (e.g., the strand can act as a carrier for a smoke modifying agent, such as a flavoring agent). Alternatively, the strand material, when incorporated into the filter rod, does not to any appreciable degree, act as a carrier for a smoke modifying agent (i.e., the strand material, as provided from the spool, is virtually devoid of added flavoring agent and does not act as a smoke modifying agent). If desired, the strand material optionally can be removed from its spool, passed through a flavoring agent applicator system (e.g., passed through a bath of flavoring agent and liquid carrier or sprayed with a mist of flavoring agent and liquid carrier) prior to being introduced into the filter material cylindrical composite. In other instances, the strand material can be configured to absorb or "wick" a flavoring agent from surrounding material, such as the filter material, once the strand is introduced into the filter material cylindrical composite. The strand material also possesses appropriate physical properties, such as pliability, tensile strength, and the like. Exemplary thread is available from Service Thread Manufacturing Co. as Product Number M-04/01-COTN-WHT-OENF-4.25#. Such a type of thread can be treated with dyes or other coloring agents of the desired type in order to provide a thread of the desired color.

In one embodiment, the strand material is different in composition from the filter material. For example, the filter material can be composed of cellulose acetate filter tow, and the strand can be composed of cotton thread. In another embodiment, the strand material can be differentiated from the filter material (e.g., the two materials can differ in appearance, such as color). For example, the filter material can be composed of white cellulose acetate filter tow, and the strand can be composed of cellulose acetate, nylon or cotton thread that is dyed or otherwise colored a different color (e.g., green, blue, red, brown, black, or the like). In some instances, the color of the strand material may correspond to the nature of the smoke modifying agent, such as the flavoring agent, applied to the filter material by the flavor injection system (e.g., a red color corresponding to a cinnamon flavor, a green color corresponding to a menthol flavor, a black color corresponding to a licorice flavor, or the like).

Filter rods generally can be further longitudinally subdivided into cylindrical shaped filter elements using techniques as are known by the skilled artisan familiar with conventional cigarette manufacturing. Rod sizes for use in the manufacture of filter elements for cigarettes can vary, but typically range in length from about 80 mm to about 140 mm, and from about 16 mm to about 27 mm in circumference. For example, a typical rod having a 100 mm length and a 24.53 mm circumference exhibits a pressure drop of from about 200 mm to about 400 mm of water as determined at an airflow rate of 17.5 cc/sec. using an encapsulated pressure drop tester, sold commercially as Model No. FTS-300 by Filtrona Corporation, Richmond, Va.

The plug wrap can vary. See, for example, U.S. Pat. No. 4,174,719 to Martin. Typically, the plug wrap is a porous or non-porous paper material. Suitable plug wrap materials are commercially available. Exemplary plug wrap papers ranging in porosity from about 1100 CORESTA units to about 26000 CORESTA units are available from Schweitzer-Mauduit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

If desired, so-called "non-wrapped acetate" filter rods possessing a strand material extending generally longitudinally therethrough also can be produced. Such rods are produced using the types of techniques generally set forth herein. However, rather than employing a plug wrap material that circumscribes the longitudinally extending periphery of the filter rod, a somewhat rigid rod is provided by plasticizing the cellulose acetate tow and applying steam to that gathered tow. Techniques for commercially manufacturing non-wrapped acetate filter rods are possessed by Filtrona Corporation, Richmond, Va. The rod-making unit employed to manufacture those types of filter rods can be suitably adapted to possess the type of strand insertion unit set forth herein.

A filter element produced from a filter rod may have a generally cylindrical shape, and the diameter thereof may be essentially equal to the diameter of the tobacco rod with which it is intended to be aligned. The ends of the filter element permit the passage of air and smoke therethrough. The filter element includes filter material (e.g., cellulose acetate tow impregnated with triacetin plasticizer) that is over-wrapped along the longitudinally extending surface thereof with circumscribing plug wrap material. That is, the filter element is circumscribed along its outer circumference or longitudinal periphery by a layer of plug wrap, and each end is open to expose the filter material.

A representative filter element typically possesses a predetermined number of strands at predetermined positions therein. For example, the number of strands longitudinally extending through the filter element can number 1, 2 or 3. A plurality of strands can be incorporated within a filter element by suitably adapting the previously described strand insertion unit to provide a plurality of strands from a plurality of spools through a single appropriately modified strand insertion tube. Alternatively, a plurality of strands can be incorporated within a filter element by suitably adapting the previously described strand insertion unit to provide a plurality of strands from a plurality of spools through an appropriate number (plurality) of strand insertion tubes.

Preferably, for a filter element having a generally circular cross-sectional shape, that filter element contains a single strand positioned therein; wherein that strand is centrally located within the filter element (e.g., the strand is located in the center of the cross-section of the filter element). An exemplary filter element preferably contains one strand having a generally circular cross-sectional shape, and that strand has diameter of at least about 0.5 mm, typically at least about 0.75 mm, and often at least about 1 mm. Typically, that strand has a diameter that does not exceed about 2.5 mm, often do not exceed about 2 mm, and frequently do not exceed about 1.5 mm. Certain preferred strands are generally circular in cross-sectional shape, and have diameters in the range of about 0.5 mm to about 2 mm in diameter, and certain highly preferred strands are about 0.75 mm to about 1.25 mm in diameter. In addition, strands can possess cross-sectional shapes other than circular. For example, strands can possess cross-section shapes that can be considered to be oval, square, rectangular, triangular, hexagonal, octagonal, star-shaped, or the like. Typically, the minimum and maximum cross-sectional widths of those strands are comparable to those diameters set forth hereinbefore for those strands that are circular in cross-sectional shape. Preferably, the strand material is disposed within the filter material of the filter element, particularly towards the central lateral region of the filter element. Most preferably, the nature of the filter material is such that the strand is secured or lodged in place within the filter element.

For a typical dual-segment filter element, the extreme mouth-end segment having a filter segment possessing the strand, typically has a length of about 15 mm to about 30 mm; and the filter segment adjacent to the tobacco rod has a length of about 5 mm to about 15 mm, most preferably about 10 mm. Preferred dual-segment filter elements have overall lengths of about 25 mm to about 35 mm.

The first segment most preferably is a generally cylindrically shaped filter segment. The first segment most preferably is manufactured using a traditional cigarette filter material, such as cellulose acetate tow, gathered cellulose acetate web, polypropylene tow, gathered polypropylene web, gathered cellulose acetate web, gathered paper, strands of reconstituted tobacco, or the like. Exemplary cigarette filter segments for multi-component cigarette filters are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones et al.; U.S. Pat. No. 5,105,838 to White et al.; U.S. Pat. No. 5,271,419 to Arzonico et al.; and U.S. Pat. No. 5,360,023 to Blakley et al.; which are incorporated herein by reference. Carbonaceous material, such as activated charcoal particles, also can be incorporated into that filter segment.

Other types of cigarettes possessing multi-component filters also can be used to incorporate those types of strand-containing filter segments representative of embodiments of the present invention. That is, cigarettes can possess multi-component filter elements having other types of formats and configurations. For example, a two-segment filter element can have one segment possessing a strand, and that segment can be positioned between the tobacco rod and the extreme mouth-end filter segment. As another example, a three-segment filter element can have one segment possessing a strand, and that segment can be positioned immediately adjacent the tobacco rod, at the extreme mouth-end of the cigarette, or as the middle filter segment between the tobacco end filter segment and the mouth-end filter segment. Strand-containing filter segments made according to the methods of embodiments of the present invention can be incorporated into the multi-component filter of cigarettes of the type set forth in U.S. Pat. No. 5,360,023 to Blakley; U.S. Pat. No. 5,396,909 to Gentry et al.; and U.S. Pat. No. 5,718,250 to Banerjee et al; U.S. Patent Application Publication Nos. 2002/0166563 to Jupe et al., 2004/0261807 to Dube et al. and 2005/0066981 to Crooks et al.; and PCT Publication No. WO 03/047836 to Xue et al.; which are incorporated herein by reference. See, also, the representative types of filter elements set forth in U.S. Pat. No. 4,046,063 to Berger; U.S. Pat. No. 4,064,791 to Berger; U.S. Pat. No. 4,075,936 to Berger; U.S. Pat. No. 4,357,950 to Berger; and U.S. Pat. No. 4,508,525 to Berger; which are incorporated herein by reference. For example, the types of objects set forth as cigarette filter components in U.S. Patent Application Publication Nos. 2004/0261807 to Dube et al., 2005/0066981 to Crooks et al. and 2005/0070409 to Deal; and PCT Publication No. WO 03/009711 to Kim, which are incorporated herein by reference, can be replaced with the types of objects set forth herein.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for providing rods for use in the manufacture of cigarette filter elements, each rod having a longitudinal axis and incorporating generally longitudinally extending filter material and a generally longitudinally extending strand within that filter material, the method comprising:

providing a continuous supply of filter material;

forming the filter material into a continuous cylindrical gathered composite;

supplying a continuous strand;

introducing the continuous strand into the continuous cylindrical gathered composite such that the continuous strand extends along a longitudinal axis of the continuous cylindrical gathered composite, introducing the continuous strand also comprising introducing the continuous strand into the continuous cylindrical gathered composite in a selected lateral disposition with respect to a cross-section of the continuous cylindrical gathered composite, the cross-section extending perpendicularly to the longitudinal axis of the continuous cylindrical gathered composite;

forming the continuous cylindrical gathered composite having the continuous strand therein into a continuous rod; and subdividing the continuous rod at pre-determined intervals to form a plurality of rod portions each having a corresponding portion of the continuous strand therein.

2. The method of claim 1, wherein forming the continuous cylindrical gathered composite having the continuous strand therein into the continuous rod comprises supplying a continuous supply of plug wrap, and circumscribing the longitudinal periphery of the continuous cylindrical gathered composite with the plug wrap to form the continuous rod.

3. The method of claim 1, comprising directing the continuous filter material though a tongue including a first entrance at one end for receiving the continuous filter material and an exit at the other end for egress of the continuous cylindrical gathered composite having the continuous strand therein, and supplying the continuous strand through the tongue at a second entrance, physically separate from the first entrance, for introducing the continuous strand into the continuous filter material.

4. The method of claim 3, comprising processing the continuous filter material comprising cellulose acetate tow using a stuffer jet device disposed upstream from the tongue.

5. The method of claim 3, wherein introducing the continuous strand comprises introducing the continuous strand using a tongue having a first entrance and an upper surface, the upper surface defining an opening therethrough comprising the second entrance, the second entrance being configured to include a tube defining a travel path of the continuous strand.

6. The method of claim 5, comprising arranging the tongue to provide a travel path for the continuous cylindrical gathered composite, and arranging the tube defining the travel path of the continuous strand to extend into the travel path of travel of the continuous cylindrical gathered composite.

7. The method of claim 1, wherein the continuous filter material comprises cellulose acetate tow.

8. The method of claim 1, comprising introducing a flavoring agent into the continuous cylindrical gathered composite.

9. The method of claim 8, comprising directing the continuous filter material through a tongue including a first entrance at one end for receiving the continuous filter material and an exit at the other end for egress of the continuous cylindrical gathered composite having the continuous strand therein, supplying the continuous strand through the tongue at a second entrance, physically separate from the first entrance and disposed toward the exit of the tongue, for introducing the continuous strand into the continuous filter material, and supplying the flavoring agent through the tongue at a third entrance, physically separate from and disposed between the first and second entrances, for receiving the flavoring agent and introducing the flavoring agent into the continuous cylindrical gathered composite.

10. The method of claim 8, comprising directing the continuous filter material through a tongue including a first entrance at one end for receiving the continuous filter material and an exit at the other end for egress of the continuous cylindrical gathered composite having the continuous strand therein, the first entrance and the exit each cooperating to direct the continuous filter material in a generally horizontal direction therebetween, supplying the continuous strand through the tongue at a second entrance, physically separate from the first entrance and disposed toward the exit of the tongue, for introducing the continuous strand into the continuous filter material, the second entrance being configured to direct the continuous strand therethrough and into the filter material in a generally vertical direction, and supplying the flavoring agent through the tongue at a third entrance, physically separate from and disposed between the first and second entrances, the third entrance being oriented in a generally vertical direction.

11. The method of claim 10, wherein introducing the continuous strand comprises introducing the continuous strand using a tongue having a first entrance and an upper surface, the upper surface defining openings therethrough comprising the second and third entrances.

12. The method of claim 10, comprising separating the continuous cylindrical gathered composite with a separating means, and introducing the flavoring agent into the continuous cylindrical gathered composite using a flavor injection means arranged in the third entrance.

13. The method of claim 12, comprising defining a travel path of the continuous strand using a tube arranged in the second entrance.

14. The method of claim 1, wherein introducing the continuous strand comprises positioning the continuous strand in the selected lateral disposition with respect to the cross-section of the continuous cylindrical gathered composite.

15. The method of claim 1, wherein supplying the continuous strand comprises supplying the continuous strand from a spool of thread.

* * * * *